US012305643B2

(12) United States Patent
Hu et al.

(10) Patent No.: US 12,305,643 B2
(45) Date of Patent: May 20, 2025

(54) PUMP BODY ASSEMBLY, COMPRESSOR AND AIR CONDITIONER

(71) Applicant: GREE GREEN REFRIGERATION TECHNOLOGY CENTER CO., LTD. OF ZHUHAI, Zhuhai (CN)

(72) Inventors: Yusheng Hu, Zhuhai (CN); Huijun Wei, Zhuhai (CN); Wang Miao, Zhuhai (CN); Peizhen Que, Zhuhai (CN); Yanjun Hu, Zhuhai (CN); Yuanbin Zhai, Zhuhai (CN)

(73) Assignee: GREE GREEN REFRIGERATION TECHNOLOGY CENTER CO., LTD. OF ZHUHAI, Zhuhai (CN)

( * ) Notice: Subject to any disclaimer, the term of this patent is extended or adjusted under 35 U.S.C. 154(b) by 243 days.

(21) Appl. No.: 18/151,691

(22) Filed: Jan. 9, 2023

(65) Prior Publication Data

US 2023/0160387 A1 May 25, 2023

Related U.S. Application Data

(63) Continuation of application No. PCT/CN2021/110096, filed on Aug. 2, 2021.

(30) Foreign Application Priority Data

Nov. 18, 2020 (CN) ..... 202011297079.0

(51) Int. Cl.
*F04C 18/356* (2006.01)
*F04C 29/00* (2006.01)
*F04C 29/02* (2006.01)

(52) U.S. Cl.
CPC ..... *F04C 18/356* (2013.01); *F04C 29/005* (2013.01); *F04C 29/023* (2013.01);
(Continued)

(58) Field of Classification Search
CPC .... F04C 18/356; F04C 29/005; F04C 29/023; F04C 2240/56; F04C 2240/603;
(Continued)

(56) References Cited

U.S. PATENT DOCUMENTS

2005/0053506 A1* 3/2005 Cho ..... F04C 23/001 418/23
2011/0067434 A1* 3/2011 Miura ..... F04C 23/001 418/157

(Continued)

FOREIGN PATENT DOCUMENTS

CN 103032328 A * 4/2013
CN 104329368 A 2/2015

(Continued)

OTHER PUBLICATIONS

CN 110397594 A (Year: 2019).*

(Continued)

*Primary Examiner* — Essama Omgba
*Assistant Examiner* — Joseph S. Herrmann
(74) *Attorney, Agent, or Firm* — Westbridge IP LLC

(57) ABSTRACT

A pump body assembly includes: a crankshaft, a first baffle plate and a second baffle plate. The crankshaft includes a first eccentric portion, a support shaft and a second eccentric portion which are arranged at intervals in an axial direction; the first baffle plate and the second baffle plate are arranged in sequence between the first eccentric portion and the second eccentric portion, a first round hole is arranged defined on the first baffle plate, the support shaft is arranged in the first round hole, so that the first baffle plate and the support shaft form a baffle plate bearing, and the baffle plate bearing has a stress relief structure for reducing a contact stress between the support shaft and the first baffle plate.

18 Claims, 6 Drawing Sheets

(52) U.S. Cl.
CPC .... *F04C 2240/56* (2013.01); *F04C 2240/603* (2013.01); *F04C 2240/605* (2013.01)

(58) Field of Classification Search
CPC .. F04C 2240/605; F04C 27/005; F04C 2/356; F04C 15/0023; F16C 17/02; F16C 33/08; F16C 35/02; F16C 2360/00; F16C 2360/42; F16C 2360/43
See application file for complete search history.

(56) References Cited

U.S. PATENT DOCUMENTS

| | | | | |
|---|---|---|---|---|
| 2014/0227116 | A1* | 8/2014 | Kanayama | F04C 18/063 417/410.3 |
| 2017/0248139 | A1 | 8/2017 | Furuya et al. | |
| 2019/0368493 | A1* | 12/2019 | Kumakura | F04C 29/023 |
| 2020/0291953 | A1* | 9/2020 | Perevozchikov | F25B 31/006 |

FOREIGN PATENT DOCUMENTS

| | | | | | |
|---|---|---|---|---|---|
| CN | 204140418 | U | | 2/2015 | |
| CN | 104389788 | A | | 3/2015 | |
| CN | 104533957 | A | * | 4/2015 | |
| CN | 104838145 | A | | 8/2015 | |
| CN | 105090042 | A | | 11/2015 | |
| CN | 105805014 | A | | 7/2016 | |
| CN | 106151036 | A | | 11/2016 | |
| CN | 110397594 | A | * | 11/2019 | F04C 29/00 |
| CN | 111287975 | A | | 6/2020 | |
| CN | 112502973 | A | | 3/2021 | |
| EP | 3567254 | A1 | | 11/2019 | |
| JP | 2004124834 | A | | 4/2004 | |
| JP | 2005337210 | A | | 12/2005 | |
| JP | 2014092044 | A | | 5/2014 | |
| JP | 2014190175 | A | | 10/2014 | |
| JP | 2016017473 | A | | 2/2016 | |
| JP | 2018004032 | A | | 1/2018 | |

OTHER PUBLICATIONS

CN 104329368 (Year: 2015).*
KR 20110026821 A (Year: 2011).*
First Office Action issued in counterpart Chinese Patent Application No. 202011297079.0, dated Mar. 18, 2022.
International Search Report issued in corresponding PCT Application No. PCT/CN2021/110096, dated Nov. 15, 2021.
Written Opinion issued in corresponding PCT Application No. PCT/CN2021/110096, dated Nov. 15, 2021.
European Search Report issued in counterpart European Patent Application No. EP 21893456.0, dated Jan. 9, 2024.
Notice of Reasons for Refusal issued in counterpart Japanese Patent Application No. JP 2022-581529, dated Nov. 21, 2023.

* cited by examiner

PUMP BODY ASSEMBLY, COMPRESSOR AND AIR CONDITIONER

CROSS-REFERENCE TO RELATED APPLICATIONS

The present application is a continuation application of International Application No. PCT/CN2021/110096, filed on Aug. 2, 2021, which claims priority to Chinese Patent Application No. 202011297079.0, filed on Nov. 18, 2020. Both of the aforementioned applications are hereby incorporated by reference in their entireties.

TECHNICAL FIELD

The present disclosure relates to the field of air conditioning technologies, in particular, to a pump body assembly, a compressor and an air conditioner.

BACKGROUND

In order to meet customer's increasing requirements for a cooling and heating capacity of an air conditioner, a displacement of a rotary compressor of a rotation type is also designed to be relatively large. Due to limitation of a size of an external unit of the air conditioner, a diameter of a shell of the compressor should be as small as possible, which requires a height of the cylinder of the pump body to be designed be higher. Especially when exhaust ports need to be installed at both ends of the large-displacement cylinder, the exhaust ports are arranged on a baffle plate, and the baffle plate needs to be designed to be relatively high accordingly, resulting in a larger span of an eccentric portion of a crankshaft between two cylinders of the pump body.

In the related technology, two eccentric portions of the rotary compressor are in a suspended state. During the working process, due to excessive deflection between the two eccentric portions, the eccentric portions and rollers are inclined, which results in wear of the rollers and a head of a sliding vane, and greatly reduces the reliability of the compressor. In order to solve this kind of problem, in the related technology, an intermediate baffle plate bearing is usually arranged between the two eccentric portions of the crankshaft to provide support, so as to reduce the deflection between the eccentric portions of the crankshaft. However, a local stress of the baffle plate bearing is too large, which easily leads to bearing wear, reducing the service life of baffle plate bearing.

SUMMARY

In view of this, the present disclosure provides a pump body assembly, a compressor, and an air conditioner, which can reduce bearing wear problems caused by an excessive local stress and prolong service life of a baffle plate bearing.

In an aspect of the present disclosure, a pump body assembly is provided, including: a crankshaft comprising a first eccentric portion, a support shaft and a second eccentric portion which are arranged at intervals in an axial direction; and a first baffle plate and a second baffle plate which are arranged in sequence between the first eccentric portion and the second eccentric portion. A first round hole is arranged on the first baffle plate, and the support shaft is arranged in the first round hole, so that the first baffle plate and the support shaft form a baffle plate bearing, and the baffle plate bearing has a stress relief structure for reducing a contact stress between the support shaft and the first baffle plate.

In some embodiments, the stress relief structure includes a first flexible groove arranged on a side of the first baffle plate facing toward the first eccentric portion, and on an end face of the first baffle plate facing toward the first eccentric portion, the first flexible groove is arranged on a side of the first baffle plate close to an inner edge of the first round hole.

In some embodiments, the pump body assembly further includes a first cylinder, the first eccentric portion is arranged in the first cylinder, the first cylinder is also provided with a sliding vane groove; along a rotation direction of the crankshaft, an included angle between a starting position of the first flexible groove and the sliding vane groove is $\alpha$, and $100° \leq \alpha \leq 115°$.

In some embodiments, an angle $\theta$ between the starting position and an ending position of the first flexible groove (16) satisfies $100° \leq \alpha+\beta \leq 170°$.

In some embodiments, a width d of the first flexible groove included in the first baffle plate satisfies $0.8\ mm \leq d \leq 1.5\ mm$.

In some embodiments, the first flexible groove is an arc-shaped groove, and a center of the arc-shaped groove coincides with an axis of the support shaft.

In some embodiments, an axial height H of the first baffle plate and a diameter D of the first round hole satisfy $0.38 \leq H/D \leq 0.6$.

In some embodiments, an exhaust port is arranged on the first baffle plate, and the exhaust port is arranged on a side of the first baffle plate close to the second baffle plate.

In some embodiments, the support shaft is provided with an oil guide hole along a radial direction, the crankshaft is provided with a central oil hole extending along an axial direction, and the oil guide hole communicates with the central oil hole.

In some embodiments, the stress relief structure includes a second flexible groove arranged on an end face of the first baffle plate facing toward the second baffle plate, and on an end face of the first baffle plate facing toward the second baffle plate, the second flexible groove is arranged on a side of the first baffle plate close to an inner edge of the first round hole.

In some embodiments, the second flexible groove is an annular groove.

In some embodiments, the stress relief structure includes a bearing bush arranged in the first round hole, and the bearing bush is sleeved outside the support shaft.

In some embodiments, one end of the first round hole close to the first eccentric portion is provided with an annular radial protrusion, and the bearing bush is stopped on the radial protrusion.

In some embodiments, an axial height of the radial protrusion is h, and $h \geq 1\ mm$.

In some embodiments, a height of the first round hole is H, an installation height of the first round hole in cooperation with the bearing bush is H1, a height of the bearing bush is H2, and $H2 \leq H1 \leq H$.

In some embodiments, a side of the bearing bush is provided with a disconnection structure, so that the bearing bush on both sides of the disconnection structure is completely disconnected.

In some embodiments, the disconnection structure is a disconnection cut.

According to another aspect of the present disclosure, a compressor is provided, including the above pump body assembly.

According to another aspect of the present disclosure, an air conditioner is provided, including the above pump body assembly or the above compressor.

According to embodiments of the present disclosure, the pump body assembly includes a crankshaft, a first baffle plate and a second baffle plate, the crankshaft includes a first eccentric portion, a support shaft, and a second eccentric portion arranged at intervals in an axial direction, and the first eccentric portion and the second eccentric portion are arranged in sequence between the first eccentric portion and the second eccentric portion. A first round hole is arranged on the first baffle plate, and the support shaft is arranged in the first round hole, so that the first baffle plate and the support shaft form a baffle plate bearing, and the stress relief structure is arranged on the baffle plate bearing to reduce a contact stress between the support shaft and the first baffle plate. In the pump body assembly, the baffle plate bearing between the two eccentric portions can effectively support a middle of the crankshaft, greatly reducing deflection of the crankshaft, and avoiding problems of wear on a head of a slide plate and rollers caused by large deflection. The baffle plate bearing has the stress relief structure for reducing the contact stress between the support shaft and the first baffle plate, which can reduce the contact stress between the support shaft and an end edge of the first baffle plate when loads of the baffle plate bearing are too large, reducing the wear of the baffle plate bearing, improving reliability of the baffle plate bearing, and prolonging the service life of the baffle plate bearing.

DETAILED DESCRIPTION OF THE EMBODIMENTS

Figure 1:
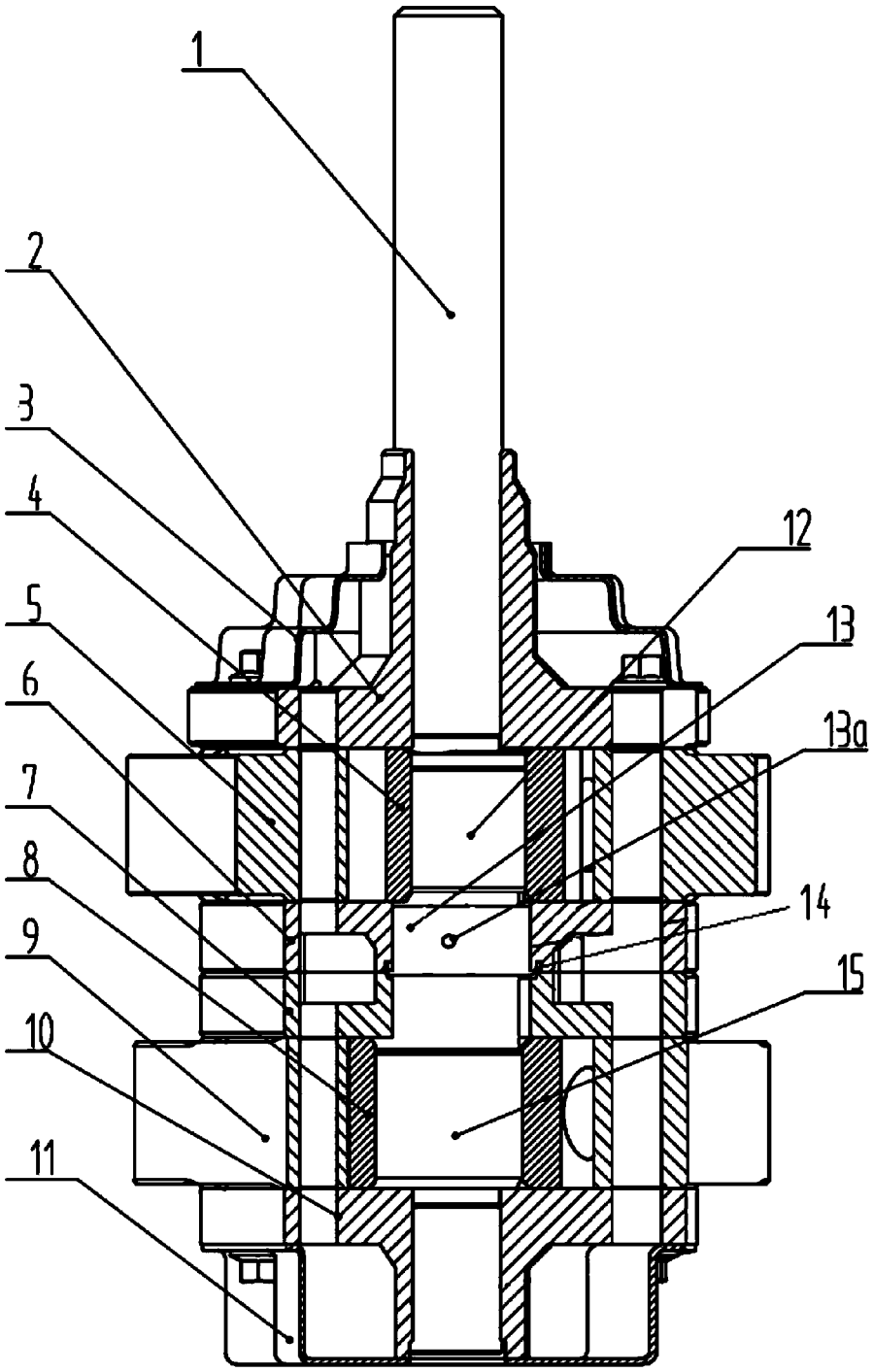
FIG. 1 is a longitudinal sectional schematic structural diagram of a pump body assembly according to an embodiment of the present disclosure.
Figure 2:
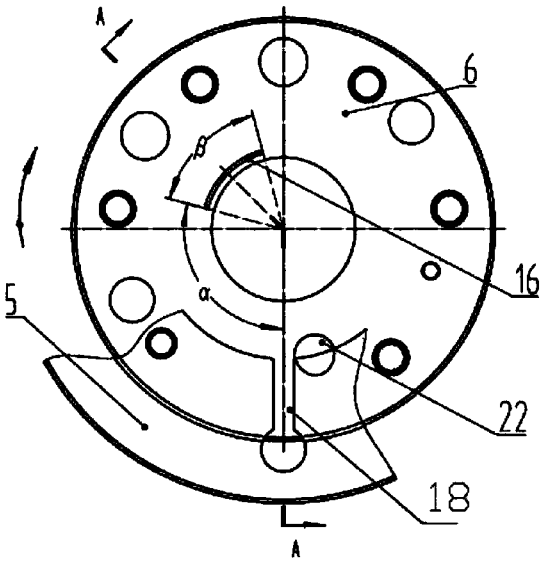
FIG. 2 is a schematic structural diagram of a first baffle plate of a pump body assembly according to an embodiment of the present disclosure.
Figure 3:
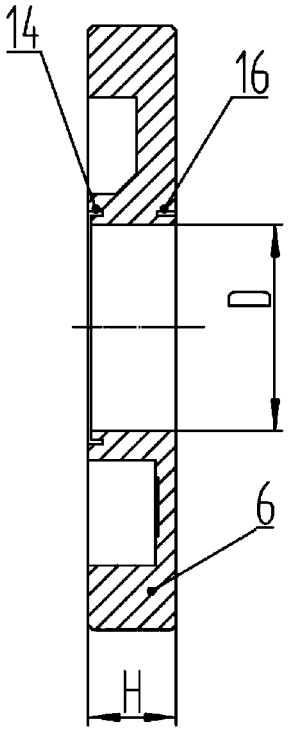
FIG. 3 is a sectional schematic structural diagram along the AA direction of FIG. 2.
Figure 4:
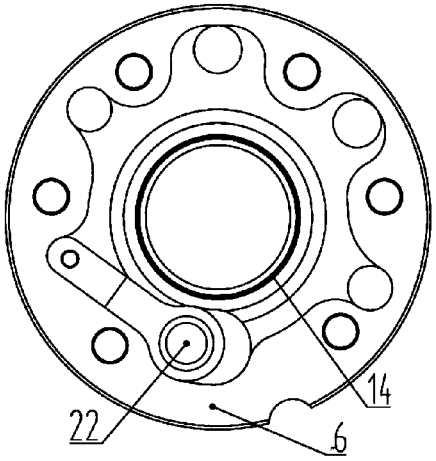
FIG. 4 is a rear view schematic structural diagram of a first baffle plate of a pump body assembly according to an embodiment of the present disclosure.
Figure 5:
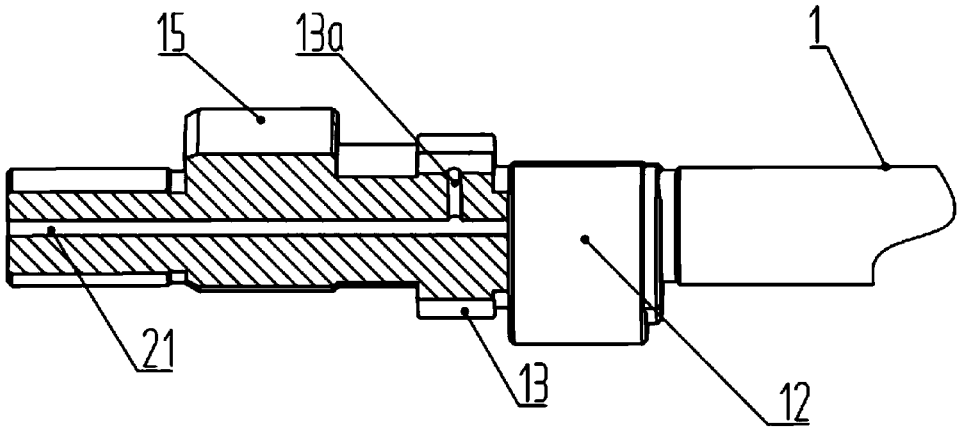
FIG. 5 is a partial sectional schematic structural diagram of a crankshaft of a pump body assembly according to an embodiment of the present disclosure.
Figure 6:
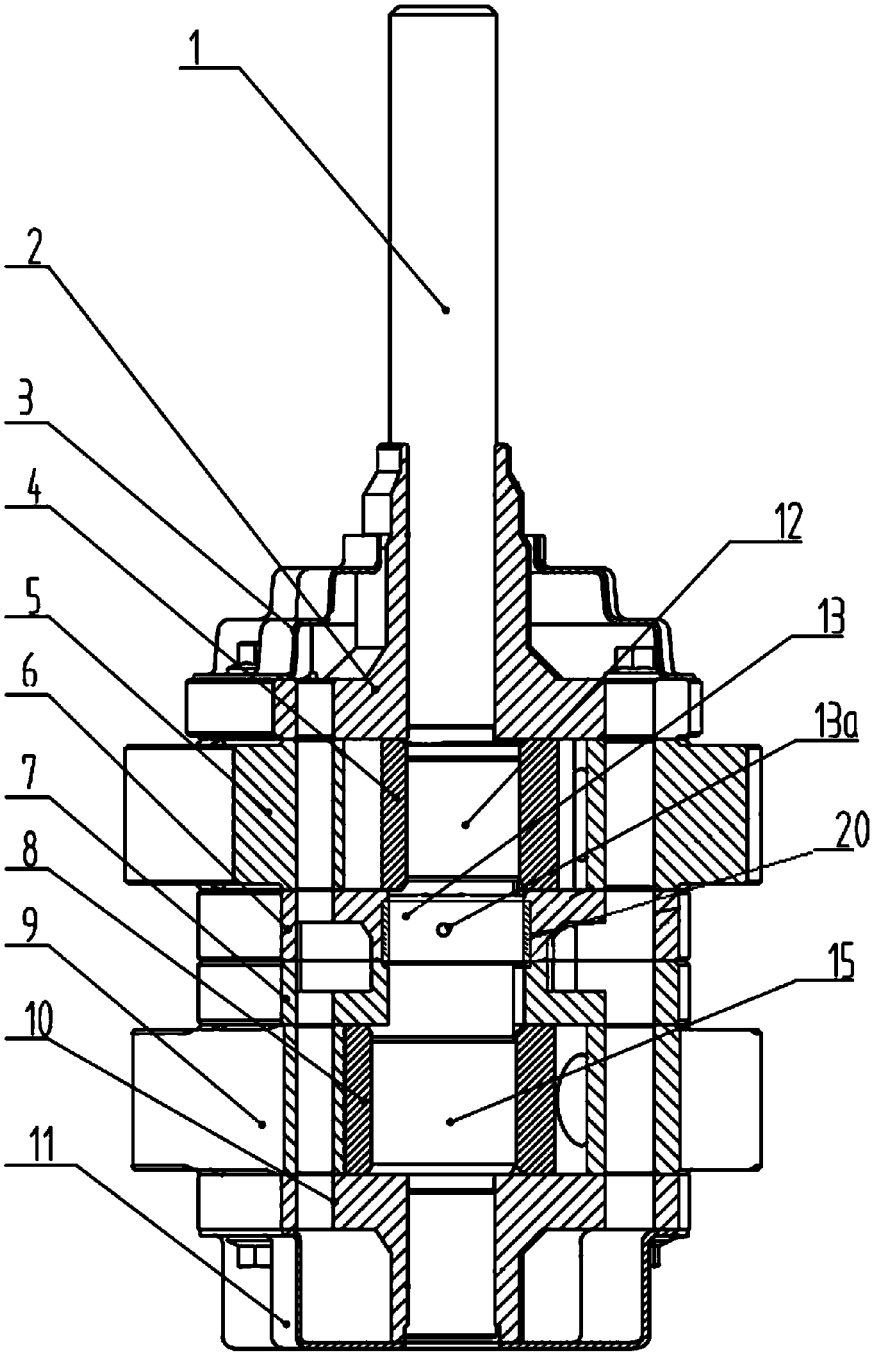
FIG. 6 is a longitudinal sectional schematic structural diagram of a pump body assembly according to an embodiment of the present disclosure.
Figure 7:
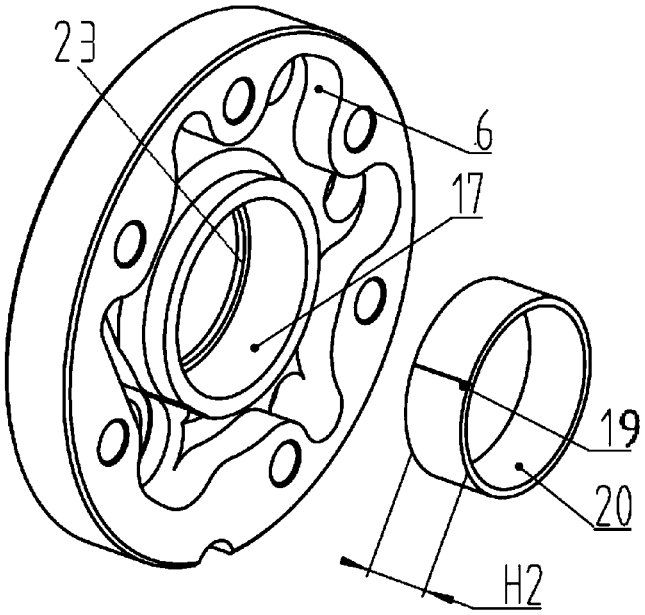
FIG. 7 is a decomposition schematic structural diagram of a first baffle plate of a pump body assembly according to an embodiment of the present disclosure.
Figure 8:
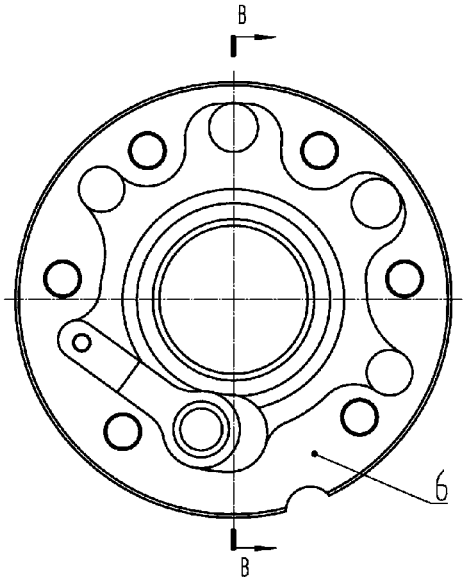
FIG. 8 is a schematic structural diagram of a first baffle plate of a pump body assembly according to an embodiment of the present disclosure.
Figure 9:
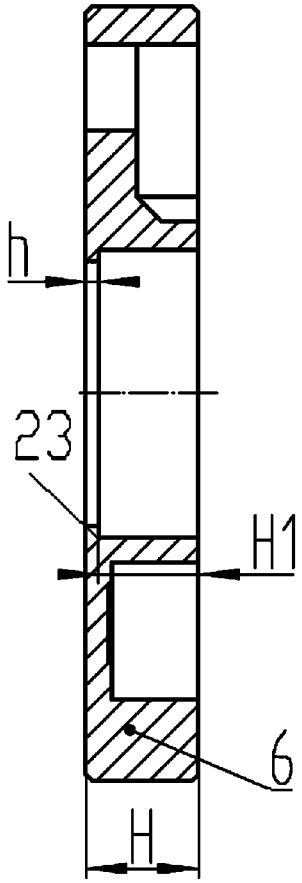
FIG. 9 is a sectional schematic structural diagram along the line BB in FIG. 8.

Referring to FIGS. 1 to 9, according to an embodiment of the present disclosure, a pump body assembly includes a crankshaft 1, a first baffle plate 6 and a second baffle plate 7, and the crankshaft 1 includes a first eccentric portion 12, a support shaft 13 and a second eccentric portion 15 which are arranged at intervals in an axial direction. The first baffle plate 6 and the second baffle plate 7 are arranged in sequence between the first eccentric portion 12 and the second eccentric portion 15. A first round hole 17 is arranged on the first baffle plate 6, and the support shaft 13 is arranged in the first round hole 17, so that the first baffle plate 6 and the support shaft 13 form a baffle plate bearing, and the baffle plate bearing has a stress relief structure for reducing a contact stress between the support shaft 13 and the first baffle plate 6.

In the pump body assembly, the baffle plate bearing between the two eccentric portions can effectively support a middle of the crankshaft 1, greatly reducing deflection of the crankshaft 1, and avoiding problems of wear between a head of a slide plate and rollers caused by large deflection. The baffle plate bearing has the stress relief structure for reducing the contact stress between the support shaft 13 and the first baffle plate 6, which can reduce the contact stress between the support shaft 13 and an end edge of the first baffle plate 6 when loads of the baffle plate bearing are too large, reducing the wear of the baffle plate bearing, improving reliability of the baffle plate bearing, and prolonging service life of the baffle plate bearing 6.

In some embodiments, the stress relief structure includes a first flexible groove 16 arranged on a side of the first baffle plate 6 facing toward the first eccentric portion 12, and on an end face of the first baffle plate 6 facing toward the first eccentric portion 12, the first flexible groove 16 is arranged on a side of the first baffle plate 6 close to the inner edge of the first round hole 17. In this embodiment, by arranging the first flexible groove 16, an easily deformable structure can be formed on a first side of the first baffle plate 6 close to the first eccentric portion 12, so that when a contact stress between the first side of the first baffle plate 6 and the support shaft 13 is too large, the first baffle plate 6 can be deformed at the contact position due to the first flexible groove 16, relatively reducing the contact stress here, reducing the wear of the baffle plate bearing, improving the reliability of the baffle plate bearing, and extending the service life of baffle plate bearing.

The first flexible groove 16 here means that by arranging a groove structure at the position of the first baffle plate 6 close to the inner edge of the first round hole 17, the first baffle plate 6 is divided into inner and outer parts by using the groove structure, and the thickness of the part arranged inside the groove structure is thin; when the first baffle plate 6 receives a large contact stress at this position, the structure at this position is prone to deformation due to the thinning of the groove structure, thereby increasing the flexibility of the first baffle plate 6 at this position, and thus the contact stress of the first baffle plate 6 at this position can be reduced due to the increased flexibility.

In order to ensure the stress-reducing effect of the first flexible groove 16, the first flexible groove 16 should be as close as possible to the surrounding wall of the first round hole 17, and in order to ensure that the inner structure of the first flexible groove 16 has a certain supporting effect, the thickness of first baffle plate 6 arranged on the inner side of the first flexible groove 16 cannot be infinitely small. In some embodiments, the thickness of the first baffle plate 6 inside the first flexible groove 16 is 1.5 mm-3 mm.

The pump body assembly also includes a first cylinder 5, a first eccentric portion 12 is arranged in the first cylinder 5, the first cylinder 5 is also arranged with sliding vane groove 18, and along the rotation direction of crankshaft 1, the angle between a starting position of first flexible groove 16 and sliding vane groove 18 is $\alpha$, and $100° \leq \alpha \leq 115°$, which can make the angle difference between the first flexible groove 16 and the sliding vane groove 18 sufficient. According to the force analysis of intermittent suction and discharge of the compressor, this structural design can effectively avoid gas leakage at the first flexible groove 16 during the operation of the compressor, and improve the reliability of the compressor during operation.

In some embodiments, the angle θ between the starting position and an ending position of the first flexible groove 16 satisfies $100° \leq \alpha+\beta \leq 170°$, the ending position of the first flexible groove 16 can be limited according to that the included angle between the starting position of the first flexible groove 16 and the sliding vane groove 18 is α, so that both the starting position and the ending position of the first flexible groove 16 can be in a suitable position, and the problem of gas leakage of the first flexible groove 16 can be avoided more effectively.

In some embodiments, when the first baffle plate 6 includes the first flexible groove 16, the width d of the first flexible groove 16 satisfies 0.8 mm≤d≤1.5 mm, which can make the first flexible groove 16 have sufficient deformation width and effectively reduce the structural strength of the first baffle plate 6 at this position, ensuring that the first baffle plate 6 inside the first flexible groove 16 can have sufficient deformation capacity, and improving the stress reduction effect of the first flexible groove 16 on the first side of the first baffle plate 6.

The first flexible groove 16 is an arc-shaped groove, and the center of the arc-shaped groove coincides with the axis of the support shaft 13, so that the structure of the first flexible groove 16 matches the structure of the support shaft 13, so a better matching effect is formed between the stress relief structure formed by the first flexible groove 16 and the support shaft 13, which further reduces the wear caused by stress during the working process of the baffle plate bearing.

In some embodiments, the axial height H of the first baffle plate 6 and the diameter D of the first round hole 17 satisfy $0.38 \leq H/D \leq 0.6$. When the first baffle plate 6 is too thick, the contact stress of edges of the baffle plate bearing will become larger, which will have an adverse effect on the reliability of the bearing. If the first baffle plate 6 is too thin, the baffle plate bearing will not have a good supporting effect on the crankshaft 1, so the height H of the first baffle plate 6 and the diameter D of the inner round hole must satisfy the relationship: $0.38 \leq H/D \leq 0.6$, so as to avoid excessive contact stress at both ends of the baffle plate bearing due to the excessive thickness of the first baffle plate 6, while ensuring good support of baffle plate bearing.

The first baffle plate 6 is provided with an exhaust port 22, and the exhaust port 22 is arranged on a side of the first baffle plate 6 close to the second baffle plate 7, which can reduce the exhaust resistance of a large-displacement compressor and improve the working performance of the compressor. An exhaust one-way stop valve is arranged at the lower end of the exhaust port 22, which can reduce the gas flow resistance and improve the energy efficiency of the compressor.

In some embodiments, the support shaft 13 is provided with an oil guide hole 13*a* in the radial direction, and the crankshaft 1 is provided with a central oil hole 21 extending in the axial direction. The oil guide hole 13*a* communicates with the central oil hole 21 to ensure that during operation of the compressor, the lubricating oil flowing through the central oil hole 21 can flow to the gap between the support shaft 13 and the first baffle plate 6 through the oil guide hole 13*a* as a bypass, which plays a good role in lubricating and cooling the bearing friction.

In some embodiments, the stress relief structure includes a second flexible groove 14 arranged on a side of the first baffle plate 6 facing toward the second baffle plate 7, and on the end face of the first baffle plate 6 facing toward the second baffle plate 7, the second flexible groove 14 is arranged on a side of the first baffle plate 6 close to the inner edge of first round hole 17.

In this embodiment, by arranging the second flexible groove 14, an easily deformable structure can be formed on the first side of the first baffle plate 6 close to the second eccentric portion 15, so that when the contact stress between the first side of the first baffle plate 6 and the support shaft 13 is too large, the second flexible groove 14 can be used to deform the first baffle plate 6 at the contact position, relatively reducing the contact stress here, reducing the wear of the baffle plate bearing, improving the reliability of the baffle plate bearing, and extending the service life of the baffle plate bearing.

When both the first flexible groove 16 and the second flexible groove 14 are arranged, both sides of the first baffle plate 6 may be provided with a stress relief structure, which can more comprehensively and effectively reduce the contact stress of the baffle plate bearing, reduce the wear of the baffle plate bearing, and improve the reliability of baffle plate bearings.

In some embodiments, the second flexible groove 14 is an annular groove, and the second flexible groove 14 is arranged coaxially with respect to the support shaft 13. Since the second flexible groove 14 is arranged on a side of the first baffle plate 6 facing toward the second baffle plate 7, and cooperates with the second baffle plate 7, but not with the end face of the roller, there is no roller sealing problem, so that the second flexible groove 14 can be formed as an annular groove, which can reduce the stress along the entire circumferential direction on the side of the first baffle plate 6 close to the second baffle plate 7, and improve the stress reduction effect of the first baffle plate 6.

Referring to FIGS. 6 to 9, in some embodiments, the stress relief structure includes a bearing bush 20 arranged inside the first round hole 17, and the bearing bush 20 is sleeved outside the support shaft 13. The difference between this embodiment and the embodiment of FIG. 1 is that in this embodiment, there are not flexible grooves arranged on both ends of the first baffle plate 6. And in order to improve the wear resistance of the baffle plate bearing, the bearing bush 20 made of wear-resistant materials is designed in the first round hole 17 to improve the reliability of baffle plate bearing.

The end of the first round hole 17 close to the first eccentric portion 12 is provided with an annular radial protrusion 23, and the bearing bush 20 stops on the radial protrusion 23. The inner diameter of the radial protrusion 23 is smaller than the inner diameter of the first round hole 17, so that the radial protrusion 23 can form an anti-leakage structure, which can prevent the problem of leakage caused by the too small sealing distance between the first roller 4 in the first cylinder 5 and the first baffle plate 6, and can also play a role in positioning the installation of the bearing bush 20. In order to ensure the structural strength of the radial protrusion 23 used to limit and prevent leakage, the axial height of the radial protrusion is h, and h≥1 mm.

In some embodiments, the height of the first round hole 17 is H, the installation height of the first round hole 17 matched with the bearing bush 20 is H1, and the height of the bearing bush 20 is H2, and $H2 \leq H1 \leq H$, which can ensure that the bearing bush 20 pressed into the first round hole 17 does not protrude to the outside of the first round hole 17, avoiding interference between the second baffle plate 7 and the bearing bush 20 during assembly, and ensuring the reliability of the overall installation structure.

In some embodiments, a side of the bearing bush 20 is provided with a disconnection structure 19, so that the bearing bush 20 on both sides of the disconnection structure 19 is completely disconnected, so that when the bearing bush 20 is pressed into the first round hole 17, the bearing bush 20 can be contracted under the action of the disconnection structure 19, and the bearing bush 20 can be easily pressed into the first round hole 17, and then the bearing bush 20 can recover under the action of the elastic force, forming a surplus cooperation with the first round hole 17.

In some embodiments, the disconnection structure 19 is a disconnection cut.

In some embodiments, the pump body assembly further includes a first muffler 3, a first roller 4, a second cylinder 9, a second flange 10, a second muffler 11 and a second roller 8, the first roller 4 is sleeved outside the first eccentric portion 12, is arranged inside the first cylinder 5, and is driven to rotate by the first eccentric portion 12, and the second roller 8 is sleeved outside the second eccentric portion 15, is arranged inside the second cylinder 9, and is driven by the second eccentric portion 15. The first muffler 3 is arranged on a side of the first flange 2 away from the first eccentric portion 12, and the second muffler 11 is arranged on a side of the second flange 10 away from the second eccentric portion 15. The first muffler 3 can be used for noise reduction for the exhaust gas on the first flange 2, and the second muffler 11 can be used for noise reduction for the exhaust gas on the second flange 10, so as to reduce the noise during the operation of the pump body assembly.

The inner circle of the second baffle plate 7 is passed by the crankshaft 1, and the second baffle plate 7 is arranged at the end of the first baffle plate 6 away from the first eccentric portion 12, which can seal the second cylinder 9. The second baffle plate 7 can adopt a conventional intermediate baffle structure.

The first cylinder 5 in the above embodiment is, for example, an upper cylinder, and the first flange 2 is, for example, an upper flange.

In other embodiments, the first cylinder 5 can also be a lower cylinder, and the second flange 10 is, for example, a lower flange.

In some embodiments, the crankshaft 1 is provided with a plurality of eccentric portions, and a support shaft 13 is arranged between two adjacent eccentric portions.

In some embodiments, the above-mentioned baffle support may also be replaced by a roller bearing support.

According to an embodiment of the present disclosure, the compressor includes a pump body assembly, and the pump body assembly is the above-mentioned pump body assembly.

According to an embodiment of the present disclosure, the air conditioner includes the above-mentioned pump body assembly or the above-mentioned compressor.

Those skilled in the art can easily understand that, on the premise of no conflict, the above-mentioned advantageous modes can be freely combined and superimposed.

The above are only preferred embodiments of the present disclosure, and are not intended to limit the present disclosure. Any modifications, equivalent replacements and improvements made within the spirit and principles of the present disclosure shall be included in the protection scope of the present disclosure. The above are only preferred implementations of the present disclosure. It should be pointed out that for those of ordinary skill in the art, some improvements and modifications can be made without departing from the technical principles of the present disclosure. These improvements and modifications should also be regarded as the protection scope of the present disclosure.

What is claimed is:

1. A pump body assembly, comprising:

a crankshaft comprising a first eccentric portion, a support shaft and a second eccentric portion which are arranged at intervals in an axial direction; and a first baffle plate and a second baffle plate which are arranged in sequence between the first eccentric portion and the second eccentric portion, wherein a first round hole is arranged on the first baffle plate, and the support shaft is arranged in the first round hole, so that the first baffle plate and the support shaft form a baffle plate bearing, and the baffle plate bearing has a stress relief structure for reducing a contact stress between the support shaft and the first baffle plate; and the stress relief structure comprises a second flexible groove arranged on an end face of the first baffle plate facing toward the second baffle plate, and the second flexible groove is arranged on a side of the first baffle plate close to an inner edge of the first round hole.

2. The pump body assembly according to claim 1, wherein the stress relief structure further comprises a first flexible groove arranged on a side of the first baffle plate facing toward the first eccentric portion, and on an end face of the first baffle plate facing toward the first eccentric portion, the first flexible groove is arranged close to a second inner edge of the first round hole.

3. The pump body assembly according to claim 2, further comprising a first cylinder, wherein the first eccentric portion is arranged in the first cylinder, and the first cylinder is also provided with a sliding vane groove; along a rotation direction of the crankshaft, an included angle between a starting position of the first flexible groove and the sliding vane groove is a, and $100° \leq \alpha \leq 115°$.

4. The pump body assembly according to claim 3, wherein an angle $\beta$ between the starting position and an ending position of the first flexible groove satisfies $100° \leq \alpha + \beta \leq 170°$.

5. The pump body assembly according to claim 2, wherein a width d of the first flexible groove included in the first baffle plate satisfies $0.8\ mm \leq d \leq 1.5\ mm$.

6. The pump body assembly according to claim 2, wherein the first flexible groove is an arc-shaped groove, and a center of the arc-shaped groove coincides with an axis of the support shaft.

7. The pump body assembly according to claim 1, wherein an axial height H of the first baffle plate and a diameter D of the first round hole satisfy $0.38 \leq H/D \leq 0.6$.

8. The pump body assembly according to claim 1, wherein an exhaust port is arranged on the first baffle plate, and the exhaust port is arranged on a side of the first baffle plate close to the second baffle plate.

9. The pump body assembly according to claim 1, wherein the support shaft is provided with an oil guide hole along a radial direction, the crankshaft is provided with a central oil hole extending along the axial direction, and the oil guide hole communicates with the central oil hole.

10. The pump body assembly according to claim 1, wherein the second flexible groove is an annular groove.

11. The pump body assembly according to claim 1, wherein the stress relief structure further comprises a bearing bush arranged in the first round hole, and the bearing bush is sleeved outside the support shaft.

12. The pump body assembly according to claim 11, wherein one end of the first round hole close to the first eccentric portion is provided with an annular radial protrusion, and the bearing bush is stopped on the radial protrusion.

13. The pump body assembly according to claim 12, wherein an axial height of the radial protrusion is h, and h≥1 mm.

14. The pump body assembly according to claim 11, wherein a height of the first round hole is H, an installation height of the first round hole in cooperation with the bearing bush is H1, a height of the bearing bush is H2, and H2≤H1≤H.

15. The pump body assembly according to claim 11, wherein a side of the bearing bush is provided with a disconnection structure, so that the bearing bush on both sides of the disconnection structure is completely disconnected.

16. The pump body assembly according to claim 15, wherein the disconnection structure is a disconnection cut.

17. A compressor, comprising a pump body assembly, wherein the pump body assembly comprises:

a crankshaft comprising a first eccentric portion, a support shaft and a second eccentric portion which are arranged at intervals in an axial direction; and a first baffle plate and a second baffle plate which are arranged in sequence between the first eccentric portion and the second eccentric portion, wherein a first round hole is arranged on the first baffle plate, and the support shaft is arranged in the first round hole, so that the first baffle plate and the support shaft form a baffle plate bearing, and the baffle plate bearing has a stress relief structure for reducing a contact stress between the support shaft and the first baffle plate; and the stress relief structure comprises a second flexible groove arranged on an end face of the first baffle plate facing toward the second baffle plate, and the second flexible groove is arranged on a side of the first baffle plate close to an inner edge of the first round hole.

18. An air conditioner, comprising a pump body assembly, wherein the pump body assembly comprises:

a crankshaft comprising a first eccentric portion, a support shaft and a second eccentric portion which are arranged at intervals in an axial direction; and a first baffle plate and a second baffle plate which are arranged in sequence between the first eccentric portion and the second eccentric portion, wherein a first round hole is arranged on the first baffle plate, and the support shaft is arranged in the first round hole, so that the first baffle plate and the support shaft form a baffle plate bearing, and the baffle plate bearing has a stress relief structure for reducing a contact stress between the support shaft and the first baffle plate; and the stress relief structure comprises a second flexible groove arranged on an end face of the first baffle plate facing toward the second baffle plate, and the second flexible groove is arranged on a side of the first baffle plate close to an inner edge of the first round hole.

* * * * *